US007374475B2

(12) United States Patent
Byers

(10) Patent No.: US 7,374,475 B2
(45) Date of Patent: May 20, 2008

(54) HAND-HELD SHARPENER DEVICE

(75) Inventor: Gary L. Byers, Columbia Falls, MT (US)

(73) Assignee: Locan Properties, LLC, Kalispell, MT (US)

( * ) Notice: Subject to any disclaimer, the term of this patent is extended or adjusted under 35 U.S.C. 154(b) by 199 days.

(21) Appl. No.: 11/054,847

(22) Filed: Feb. 9, 2005

(65) Prior Publication Data

US 2006/0178100 A1 Aug. 10, 2006

(51) Int. Cl.
*B24D 15/00* (2006.01)

(52) U.S. Cl. ..... 451/523; 451/556; 76/82

(58) Field of Classification Search ..... 76/82, 76/83, 86, 87, 88, 89; 451/523, 524, 525, 451/552, 556

See application file for complete search history.

(56) References Cited

U.S. PATENT DOCUMENTS

| | | | | | |
|---|---|---|---|---|---|
| 8,458 | A | * | 10/1851 | Fay | 125/29 |
| 289,879 | A | * | 12/1883 | Almond | 451/524 |
| 455,917 | A | | 7/1891 | Blood | |
| 0,540,944 | A | | 6/1895 | Bold | |
| 0,543,552 | A | | 7/1895 | Hayes | |
| 0,572,190 | A | | 12/1896 | Brinkman | |
| 0,950,530 | A | | 3/1910 | Dow | |
| 1,032,910 | A | * | 7/1912 | Jackson | 76/86 |
| 1,061,708 | A | | 5/1913 | Vollmer | |
| 1,188,094 | A | | 6/1916 | Olson et al. | |
| 1,258,124 | A | | 3/1918 | Lake | |
| 1,573,875 | A | | 2/1926 | Shaw | |
| 2,067,594 | A | * | 1/1937 | Brown | 451/515 |
| 2,114,364 | A | | 4/1938 | Kilbride et al. | |
| 2,347,246 | A | * | 4/1944 | Barrett | 451/556 |
| 3,149,506 | A | | 9/1964 | Heinmiller | |
| 3,293,949 | A | | 12/1966 | Lindsay | |
| 3,921,341 | A | | 11/1975 | Thompson | |
| D248,210 | S | | 6/1978 | Dill | |
| 4,418,588 | A | | 12/1983 | Byers | |

(Continued)

FOREIGN PATENT DOCUMENTS

| | | |
|---|---|---|
| CH | 0198473 | 6/1938 |

(Continued)

OTHER PUBLICATIONS

7325 Blade Sharpener. Downloaded Feb. 16, 2006 at http://www.magtool.net/plasticpipetools.html. Earliest publication date available through www.webarchive.org is May 7, 2003 (See at http://web.archive.org/web/*/http://www.magtool.net/plasticpipetools.html.

*Primary Examiner*—Jacob K. Ackun, Jr.
(74) *Attorney, Agent, or Firm*—Dowrey Rickards PLLC

(57) ABSTRACT

A hand-held sharpener device for sharpening and deburring convergent surface cutting edge implements including an elongated cylindrical body having a central area mounting a plurality of sharpener bit assemblies and opposite end areas providing hand grips for holding and moving the sharpener device across a cutting edge to be sharpened. One of the sharpener bit assemblies includes two associated sharpening bits for sharpening blades having two converging cutter surfaces and a second sharpener bit assembly includes a sharpening bit and a dummy bit for sharpening blades having only one cutting surface. The sharpener bits and the dummy bit are held and clamped in bit receiving cavities in mating sections of the sharpener body.

12 Claims, 5 Drawing Sheets

U.S. PATENT DOCUMENTS

| | | | | |
|---|---|---|---|---|
| 4,494,340 | A | | 1/1985 | Carter |
| 4,502,254 | A | | 3/1985 | Carter |
| 4,510,824 | A | | 4/1985 | Byers |
| 4,530,188 | A | | 7/1985 | Graves |
| 4,550,632 | A | | 11/1985 | Inman |
| 4,599,919 | A | | 7/1986 | Fortenberry |
| 4,665,778 | A | * | 5/1987 | Lubin et al. ..... 76/83 |
| 4,731,957 | A | | 3/1988 | Weisinger |
| 4,751,795 | A | | 6/1988 | Jenne |
| D309,415 | S | | 7/1990 | Shimizu |
| 4,974,322 | A | | 12/1990 | Butka |
| 5,040,435 | A | | 8/1991 | Millman |
| 5,046,385 | A | | 9/1991 | Cozzini et al. |
| 5,163,251 | A | | 11/1992 | Lee |
| D338,814 | S | | 8/1993 | Wright, Jr. et al. |
| 5,291,805 | A | | 3/1994 | Byers |
| 5,357,717 | A | | 10/1994 | Friel, Jr. et al. |
| 5,363,602 | A | | 11/1994 | Anthon et al. |
| 5,390,431 | A | | 2/1995 | Friel |
| 5,404,679 | A | | 4/1995 | Friel, Jr. et al. |
| 5,431,069 | A | | 7/1995 | Davis |
| 5,461,943 | A | | 10/1995 | Munkel |
| D365,740 | S | | 1/1996 | Smith |
| 5,488,885 | A | | 2/1996 | Byers |
| D367,598 | S | | 3/1996 | Fortenberry |
| D369,081 | S | | 4/1996 | Byers et al. |
| D375,241 | S | | 11/1996 | Pigott |
| 5,673,599 | A | * | 10/1997 | Byers et al. ..... 76/86 |
| 5,679,068 | A | | 10/1997 | Byers et al. |
| D387,262 | S | | 12/1997 | Byers et al. |
| D394,596 | S | | 5/1998 | Byers et al. |
| 6,101,898 | A | | 8/2000 | Byers |
| D453,290 | S | | 2/2002 | Huang |
| 6,393,946 | B1 | | 5/2002 | Kenesky et al. |
| D470,382 | S | | 2/2003 | Kurz |
| D475,599 | S | | 6/2003 | Liu |
| 6,726,543 | B1 | | 4/2004 | Klosterman |

FOREIGN PATENT DOCUMENTS

| | | |
|---|---|---|
| DE | 2519205 | 11/1976 |
| GB | 0010843 | 0/1908 |
| GB | 0652581 | 4/1951 |

* cited by examiner 10
11
12
13
14
16
24
25
26
27
28
32
33
34
36
41
42
52

HAND-HELD SHARPENER DEVICE

BACKGROUND OF THE INVENTION

1. Field of the Invention

The present invention relates to hand-held sharpening devices for sharpening convergent-edge bladed implements such as knives, shears, cleavers, axes and hatchets. Although not limited to any particular bladed implement, the present sharpener is particularly adaptable for use with a variety of larger implements such as axes, hoes, garden shears and the like as well as camping tools which may have either double or single-ground cutting faces.

2. Description of the Prior Art

A wide variety of hand-held sharpening devices are available in the prior art which rely upon intersecting circular elements or intersecting straight blade elements, see for instance U.S. Pat. No. 4,510,824, which define a nip or V-shaped cavity through which the tool blade passes in order to be sharpened. These devices may be either of the type in which the blade is pulled through a stationary sharpening device or the type wherein the sharpener is drawn along the blade edge in order to effect the sharpening action. U.S. Pat. Nos. 4,418,588 and 5,679,068 are examples of such hand-held sharpening devices that are primarily designed for pulling across or along the blade which is held stationary such as a lawn mower blade, shear blades or the like. Following are examples of sharpener devices of the type wherein the device is held stationary, such as being bench mounted or being hand held, while the knife or other bladed instrument is drawn through the nip or V-shaped cavity for sharpening.

U.S. PATENTS

U.S. Pat. Nos. 4,494,340, 4,731,957, 5,163,251, 6,393,946

The concern with all such sharpener devices is twofold. First, maintaining the hands as far away from the edge being sharpened as possible for safety reasons and second, that of providing sufficient grip or leverage on the sharpener device in order to maintain contact pressure between the blade edge being sharpened and the sharpener bits. These concerns are especially true with hand-held sharpeners used for sharpening larger or heavier bladed implements such as axes, garden shears or the like because of the size of the implements and/or awkwardness in supporting the implement during sharpening. The present invention provides a safe and improved sharpener bit holder and integrated handle combination allowing for mounting of multiple sharpener assemblies and a two handed grip for pressuring and drawing the sharpener bits along the blade to be sharpened.

SUMMARY OF THE INVENTION

A hand-held sharpener device having an elongated substantially hollow tubular body with a central area for mounting one or more sharpener bit assemblies. Hand grip areas are provided on opposite terminal ends of the body for holding the sharpener device with both hands while moving the device along the convergent blade surfaces and cutting edge of an implement being sharpened. The elongated sharpener body is formed in two mating body sections of molded plastic or other material, providing suitable cavities for mounting sharpener bits in the central section of the body. The sharpener assemblies may be of the type utilizing suitably shaped, overlapping, angularly disposed sharpener bits or blades forming a V-notch for blade sharpening. The plurality of sharpener bit assemblies may be longitudinally spaced along the central area of the sharpener body with the mating body sections providing suitable sharpener bit cavities for mounting the sharpener bits which are held securely in place by clamping the body sections together with screw fasteners or the like. The plurality of sharpener bit assemblies include at least one double-ground surface blade sharpener and one single-ground cutting surface blade sharpener. The elongated sharpener body enables the mounting of a plurality of sharpener bit assemblies in its central area while providing widely spaced hand gripping surfaces for holding and moving the sharpener device across a cutting edge to be sharpened. Blade guide means are located on the surface of the sharpener body in association with the cutter bit assemblies for guiding the blade edge to be sharpened at the proper angle as the blade edge passes through the V-shaped sharpening notch.

DESCRIPTION OF THE PREFERRED EMBODIMENT

Figure 1:
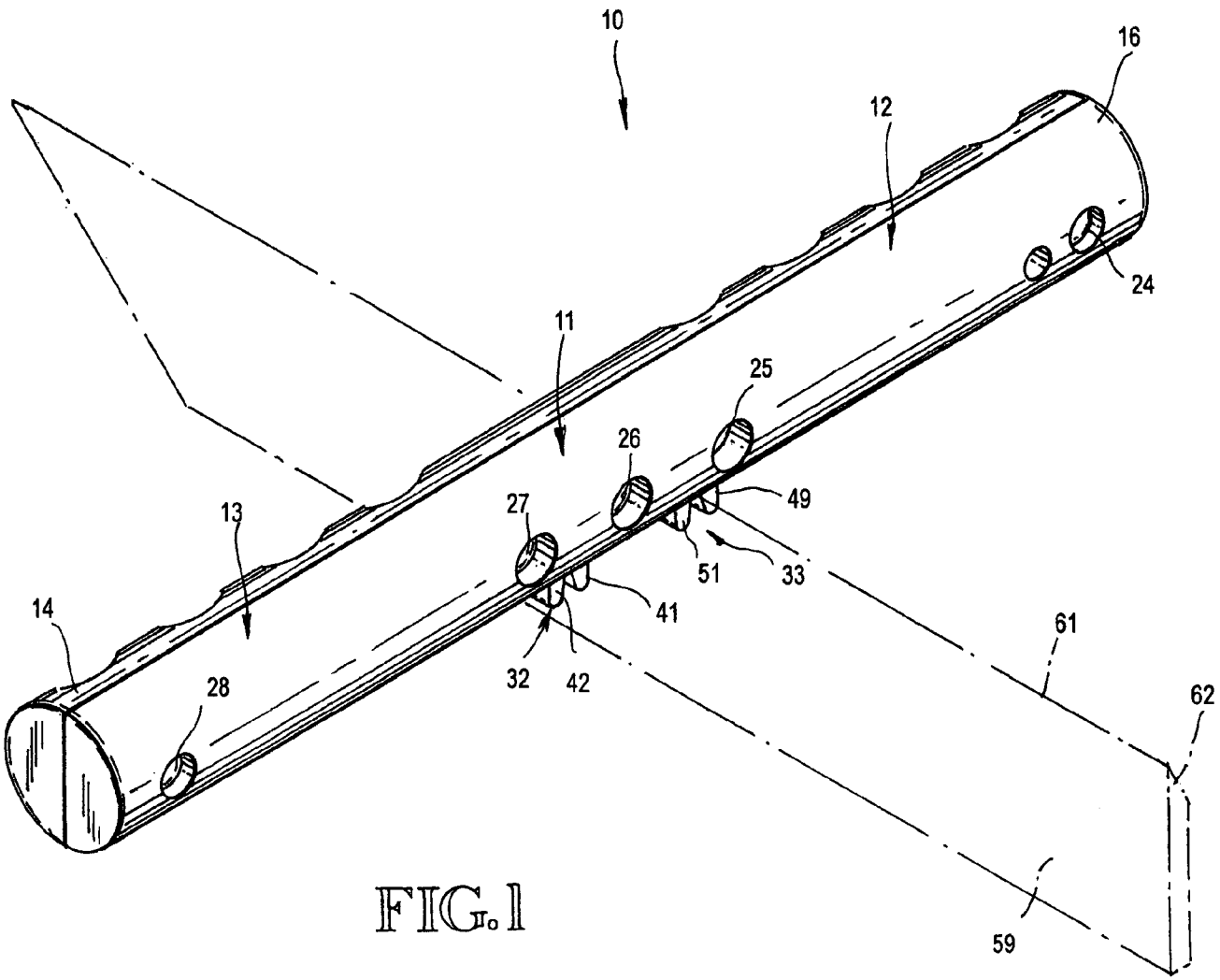
FIG. 1 is a perspective view of the hand-held sharpener of the present invention illustrating the application of the sharpener device to a single-ground cutting surface.
Figure 1A:
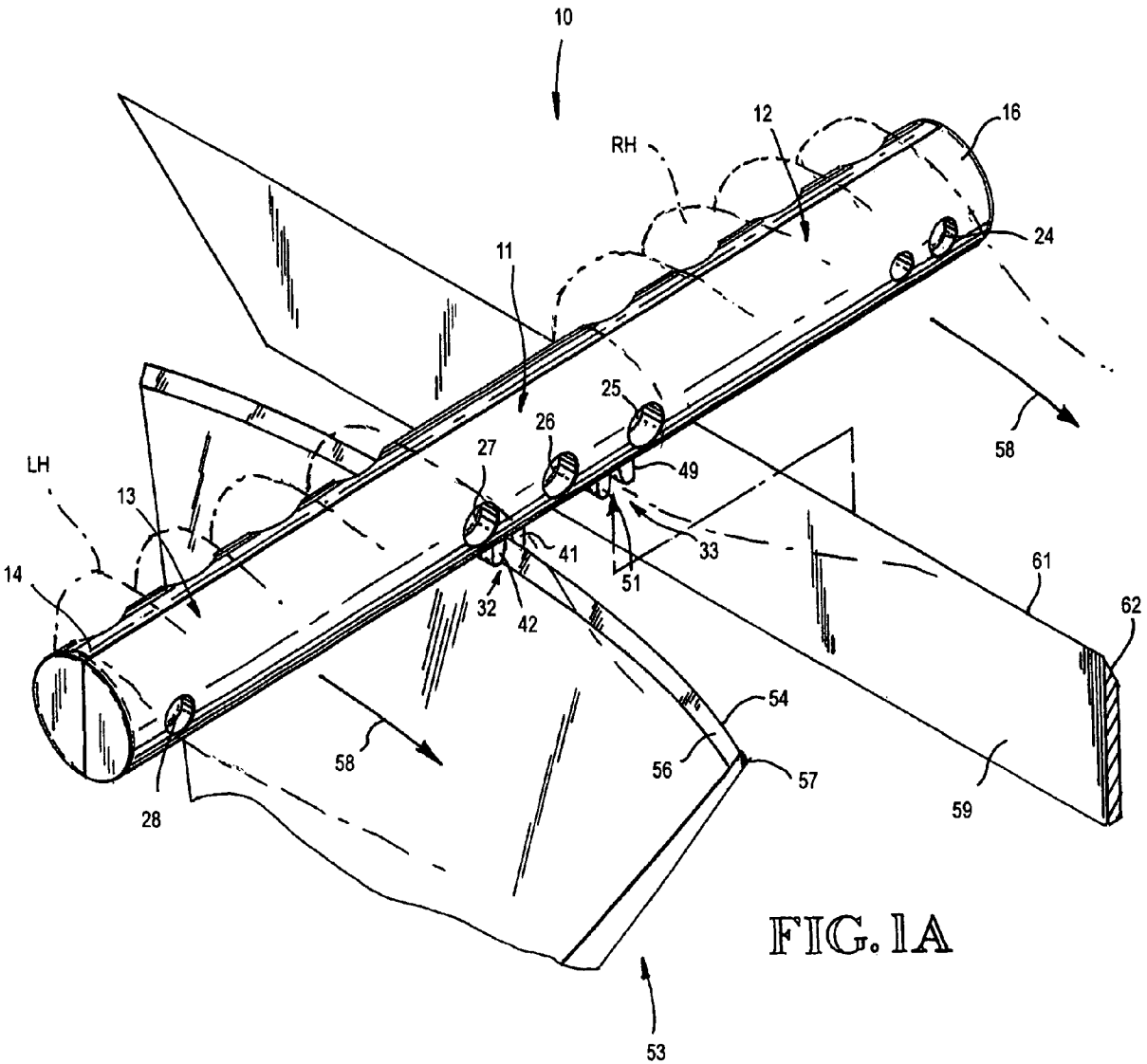
FIG. 1A is a perspective view of the hand-held sharpener and its mode of use as applied to both single and double-ground cutting surfaces.

The hand-held sharpening device of the present invention comprises an elongated body indicated generally at 10 which includes a central sharpener bit mounting area 11 and right and left hand grip areas 12 and 13 on opposite terminal ends respectively as viewed in FIGS. 1 and 1A. The body 10 is preferably constructed from molded plastic although other materials such as metal or composites may be used to form the sharpener body. The body 10 in the preferred embodiment has a right circular cylindrical or tubular form and may be generally hollow with any desired internal reinforcing webs or the like as will be presently explained. The elongated hollow tubular hard plastic form lends strength and rigidity to the overall sharpener body. In the alternative, instead of the elongated circular cross section, any suitable cross section may be utilized such as a multiple faceted polygon or irregular flat or curved sided configuration. In practice the suggested length of the sharpener body may be approximately 10"-12" with a suggested diameter of approximately 1"-1½" for easy gripping. These dimensions, however, are not critical and may be varied as desired for any particular intended use.

Figure 8:
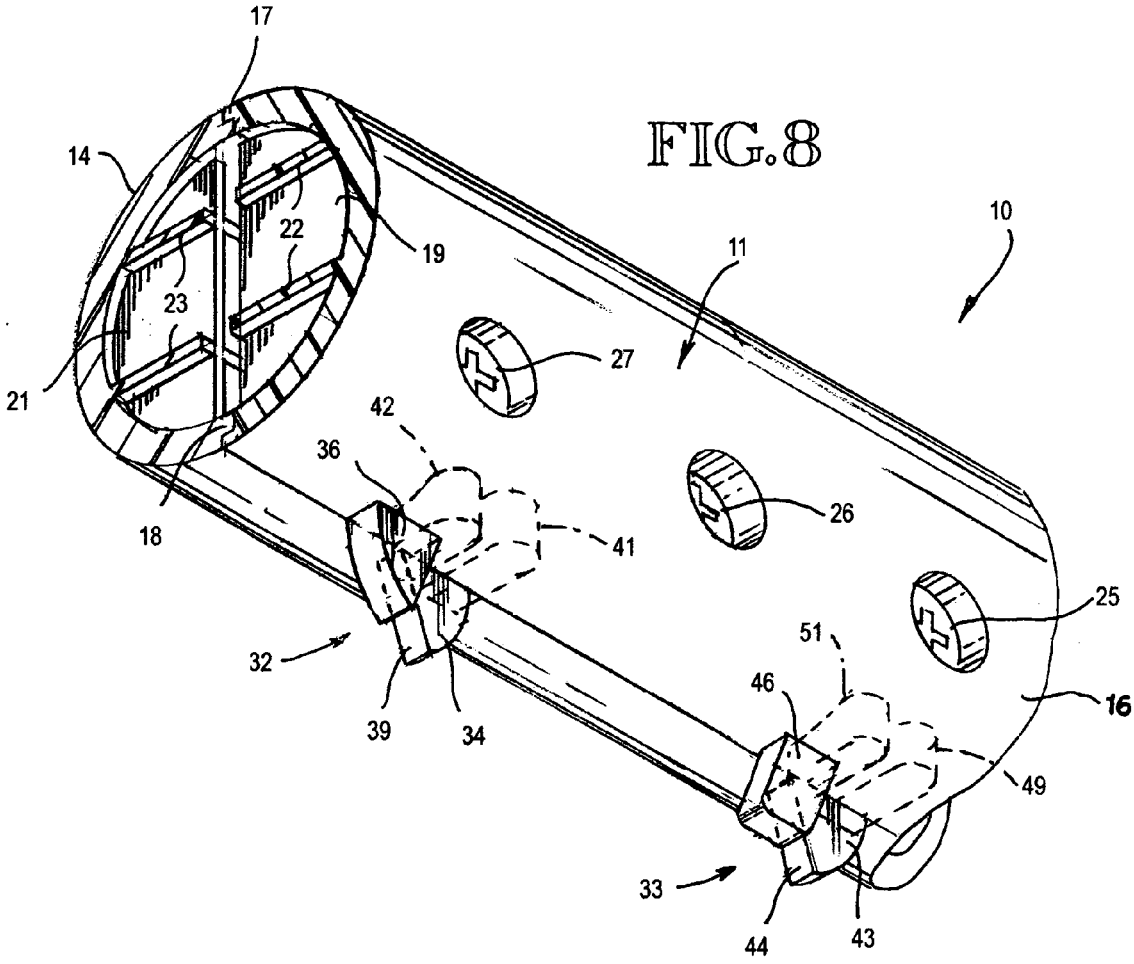
FIG. 8 is a partial perspective view of the central section of the sharpener device illustrating further detail of the sharpener body and the sharpener bit mountings.
Figure 9:
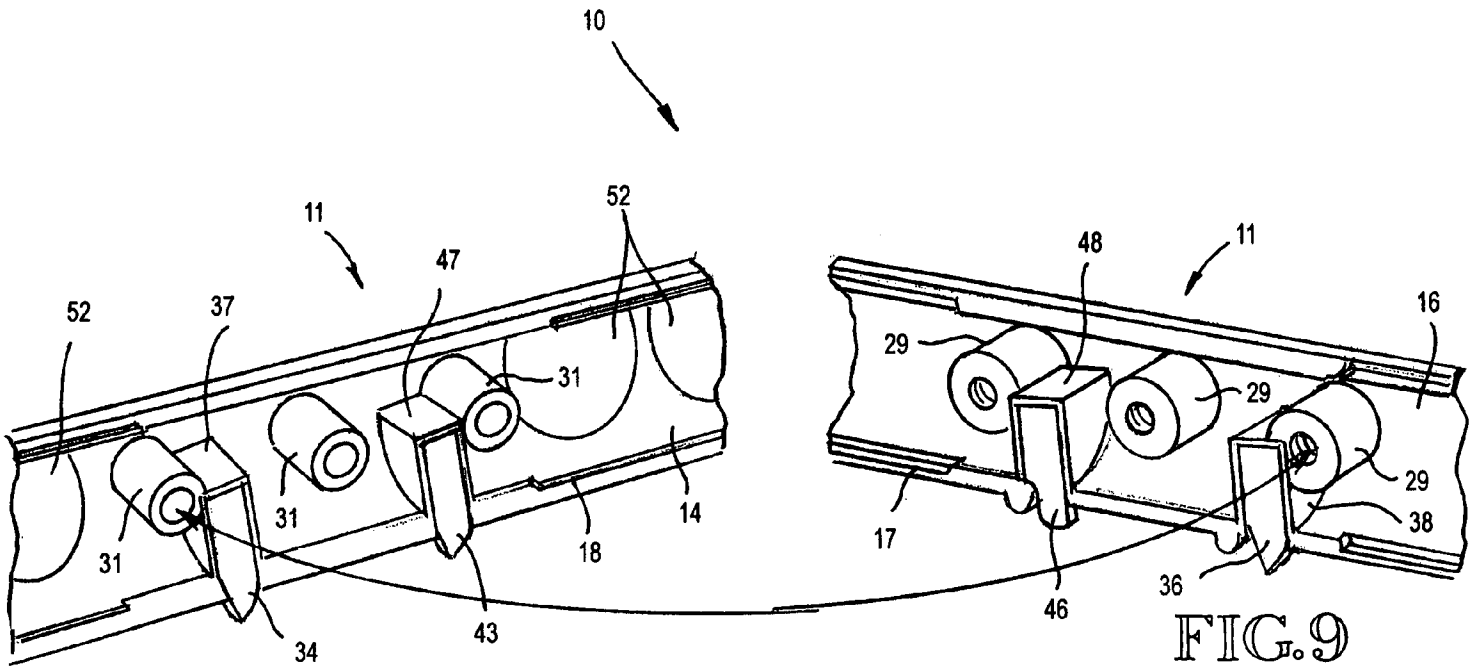
FIG. 9 is an exploded view showing the cutter bit mountings within the sharpener body.

The sharpener body 10 may be made up of two mating sections, including the body base section 14 and the body cover section 16. In the present embodiment, these sections may be essentially equal in size and formed with closed ends as illustrated in the drawings. Referring to FIGS. 8 and 9, the longitudinal edges of the two sections of the sharpener body will be formed with peripheral interfitting and matching ribs 17 and 18 for the purpose of positioning and aligning the two sections when they are assembled as shown in FIG. 8. It will be understood, of course, that any alternate form of matching grooves and ribs may be utilized in order to position the two assembled body sections. In addition, cross webbing may be utilized along the length of the two sections 14 and 16 to lend added strength to the molded plastic body. Such cross webbing is illustrated in FIG. 8 wherein the cover section 16 includes any number of the webs 19 along its longitudinal axis and the base section 14 will similarly include a number of webs such as that shown at 21 in FIG. 8. Also, the body sections may be provided with longitudinal braces 22-23 with the understanding that the longitudinal bracing as well as the cross webs 19-21 may be used in any configuration or number and are preferably integrally molded at the time the two body sections are formed. The cross webs 19-20, as well as the longitudinal braces 22-23, have been omitted from FIG. 9 for clarity of description of the mounting of the sharpener bits presently to be described. In the illustrated embodiment, the body base and cover sections 16 and 14 respectively are joined by means of a plurality of longitudinally spaced screw fasteners 24-28 for tightly clamping the two sections together and to secure the sharpener bits in position. As shown in FIG. 9, fastener receiving reinforced sections 29 are located in the hollow portions of the body cover section 16 and mating and aligned fastener receiving reinforced sections 31 are located in the body base section 14. It will be understand that the remaining screw fasteners 24-28 are also provided with the fastener receiving reinforced sections as described. The screw fasteners are received in suitable openings in the reinforced sections 29 of the body portion 16 and the reinforced sections 31 in the mating body portion 14 will be provided with internally threaded bores as illustrated in FIG. 9. Preferably, the plastic material utilized for the sharpener body 10 will be of sufficient hardness and durability to alone provide sufficient holding strength for the screw fasteners so as to tightly and securely clamp the sections 14 and 16 together once they are aligned. In the event that softer plastics are utilized, it may be necessary to utilize some expedient such as metal liners in the reinforced members 29 and 31 for receiving the screw threaded fasteners. It is to be understood that the exact configuration of the fastener receiving reinforced sections described may be varied and that the exact number of such reinforced sections and screw fasteners, as well as their location, may be varied as desired in order to achieve tight clamping of the two body sections 14 and 16. In order to maintain the surface of the body 10 smooth and flush, the heads of the screw fasteners 24-28 may be recessed in suitable recesses in the surface of the cover 16 as illustrated in FIGS. 1 and 8. Additionally, it may also be possible to reverse the directional mounting of the screw members 24-28 so as to recess the heads of the screw members within the surface of the body base section 14. Alternative fastening means for the two body members may also be chosen as long as they do not interfere with hand gripping of the opposite end portions of the body 10 and serve to hold the two sections tightly together. In the event that the two body sections 14 and 16 are not intended to be separated for any purpose, it would of course be possible to adhesively secure the two body sections. If alternate means are provided for securely mounting sharpening bits or blades within the sharpener body 10, it may be possible to mold the body 10 of a single unitary piece of plastic.

Referring to FIG. 8, the central area 11 of the sharpener body provides a mounting for a first sharpener bit assembly, indicated generally at 32, designed for sharpening double-ground cutting surface implements such as knives, axes and the like and a second sharpener bit assembly, indicated generally at 33, for sharpening single-ground cutting surface implements such as scissors, shears and the like. Although the illustrated embodiment locates the double face sharpener assembly 32 on the left side of the body 10 as shown in FIG. 1 and the single face sharpener assembly 33 on the right side of the body, it will be understood that these positions may be reversed. Likewise, the exact location of the two sharpener bit assemblies along the length of the sharpener body as well as the exact distance between the assemblies may be varied. It will also be noted that, although the configuration of the tubular sharpener body 10 permits the mounting of a plurality of sharpener bit assemblies in the preferred embodiment, it would, however, be possible to mount or utilize only a single sharpener bit assembly.

Referring again to FIGS. 8 and 9, the sharpener assembly 32 includes first and second sharpener bits or blades 34 and 36, each sharpener blade being mounted in one of the mating sections of the sharpener body. The sharpener blades 34 and 36 are in the form of replaceable inserts mounted in generally rectangular blade cavity structures 37 and 38 respectively formed in the hollow body sections. The blade or bit cavities provided by the cavity structures 37 and 38 are disposed at predetermined angles to receive the blades 34 and 36 so that the sharpening edges of the blades intersect at a desired angle. As shown most clearly in FIG. 8, the blades 34 and 36 are in face-to-face contact when the two sections of the sharpener body are assembled so as to form the desired V-shaped sharpening notch through which the blade to be sharpened passes. The sharpener blades 34 and 36 are normally tungsten carbide type blades which contact opposite sides of the blade to be sharpened. The sharpener bits may be readily removed from the associated cavities for sharpening or replacement purposes. Each sharpener bit may have a cutting surface such as the surface 39 shown on the blade 34 with a relief angle on the surface being normally in the range of 3°-5° although this angle may be varied for any design requirement as will be understood by those versed in the art. Located on the outside surface of the cover section 16 are two generally parallel upstanding ridge members 41 and 42 which define a guide slot or groove for guiding the blade to be sharpened through the sharpener device so as to contact the sharpening edge surfaces of the bits 34 and 36 at the desired angle. The guide ridges 41 and 42 may be molded into the body section and, in some cases, be located at a predetermined angle relative to the V-groove provided by the cutting blades.

The second sharpener assembly 33 is longitudinally spaced from the assembly 32 in the central area of the sharpener body and includes a single sharpener bit or blade 43 with a single angled cutting surface 44. It will be understood that the blade 43 and cutting surface 44 may be substantially identical with that described for the blade 34 and cutting face 39. This cutting blade will also be of the tungsten carbide type for sharpening the single cutting surface and cutting edge of implements such as scissors, shears and the like. The blade 43 cooperates with a dummy blade or non cutting metal bit 46 which cooperates with the cutting blade 43 to sharpen single edge tools in a well known manner. The sharpening blade 43 and the dummy blade 46 are mounted in cavity structures 47 and 48 respectively and may be held in place in the same manner described for the cutter blades 34 and 36. Parallel guide ridges 49 and 51 are also provided on the surface of the body section 16 and cooperate with the cutting and non cutting bits 43 and 46 respectively in the manner described for the guide ridges 41 and 42. It will be noted that the blade cavities provided by the structures 37 and 38 in the mating body sections are slightly less in depth than the blade thickness so that, when the two body sections are tightly fastened together, the blades are brought into tight frictional engagement with each other and the cavity walls as a result of which they are firmly held in position. In addition, the blade inserts are sized so as to engage in a press fit within the cavities provided. Alternatively, adhesives or other bonding agents could be utilized to enhance the mounting of the blades.

Figures 2, 3, 4, 5, 6, 7:
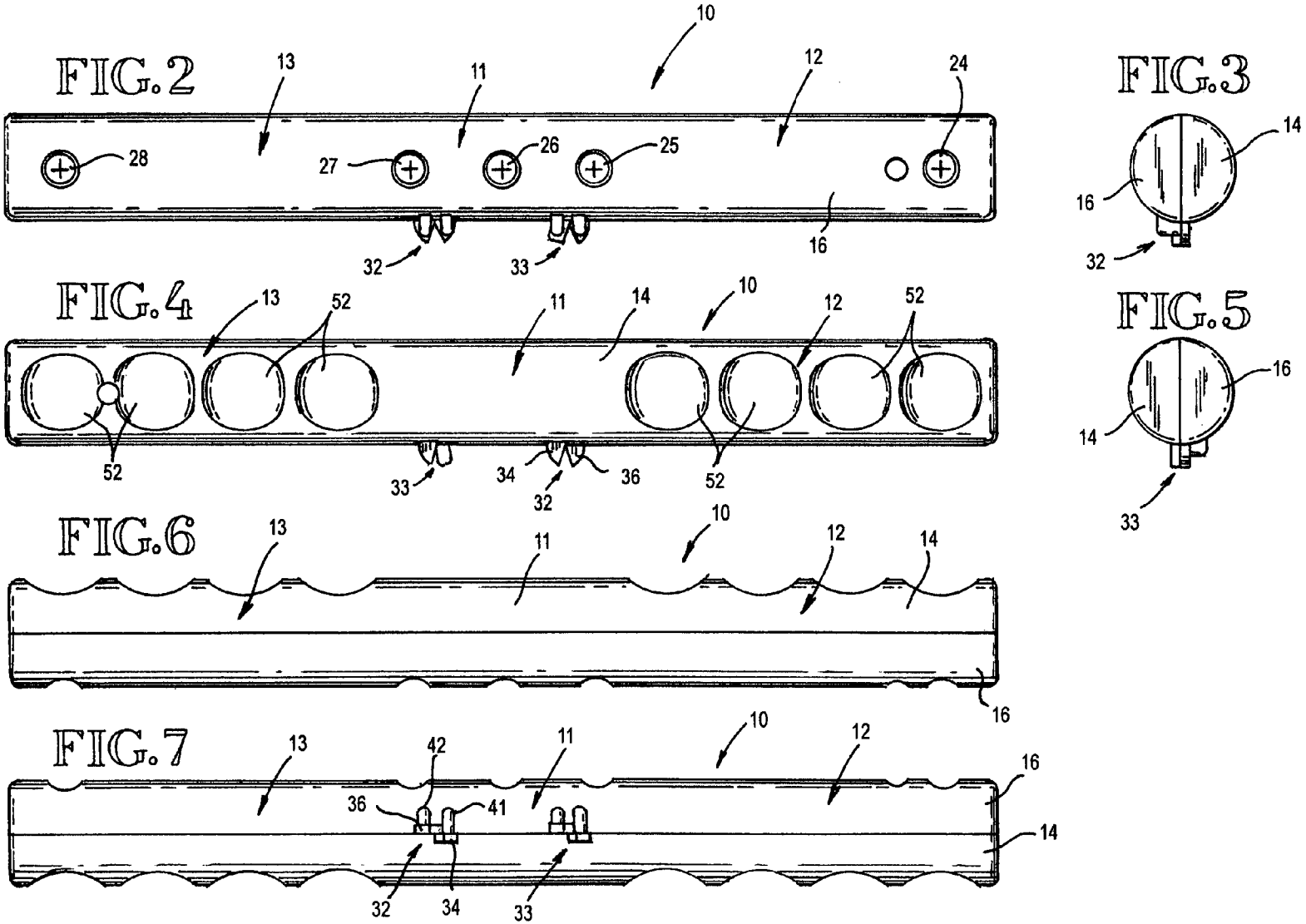
FIG. 2. is a right side elevation of the sharpener device.
FIG. 3 is a right end elevation of the sharpener device.
FIG. 4 is left side elevation of the sharpener device.
FIG. 5 is a left end elevation of the sharpener device.
FIG. 6 is a top plan view of the sharpener device.
FIG. 7 is a bottom plan view of the sharpener device.

As seen most clearly in FIGS. 4, 6 and 7, the base body section 14 may be provided with a plurality of hand-grip enhancing depressions 52 on each terminal end area of the sharpener body. As illustrated in the drawings, the depressions 52 may be four in number on each end of the elongated body to position the fingers tightly about the cylindrical body 10 when the sharpener device is moved over the edge to be sharpened. The depressions 52 may be conveniently placed on the side surface of either one of the body sections and located in a plane generally parallel to the plane of the sharpener assemblies 32 and 33. As an alternative to the depressions 52, other expedients such as surface treatment or other gripping configurations could be used as grip enhancers. FIGS. 1 and 1A illustrate the manner of use of the sharpener device 10 on an axe 53 which has a cutting edge 54 requiring the sharpening of the two ground cutting faces 56 and 57. The sharpening device is held with both hands as shown in FIG. 1A and the sharpening bits 34-36 are placed on the axe edge 54 with the edge 54 located between the guide ridges 41-42. The sharpener device is then pulled along the cutting edge of the axe in the direction indicated by the arrows 58. The axe may be engaged in a wood block, held in a vice or otherwise held stationary. If the blade to be sharpened has a single cutting surface such as the large shear blade 59, having the cutting edge 61 and a single-ground surface 62, the manner of use is the same as just described for sharpening the axe except that the cutting edge of the shear blade is passed between the cutting bit 43 and the dummy bit 46 and between the guide ridges 49 and 51.

Although the present preferred embodiment has been described in terms of certain specific structures, it will be apparent to those skilled in the art that many variations and modifications are possible. For instance, the surface configuration and the cross section of the sharpener body may be altered without departing from the spirit and scope of the invention. The exact positioning of the screw threaded clamping means, the details of the sharpener assemblies 32 and 33 and the length, as well as general diameter of the sharpener body 10, may be altered by one of ordinary skill in the art. Other sharpener configurations such as rotary discs or abrasive elements could also be substituted for the illustrated sharpener bits without departing from the scope and intent of the invention. With the preferred embodiment of the invention described, a firm grip may be maintained on the elongated sharpener body for regular sharpening or deburring use as well as for use on larger implements such as garden tools, camping equipment, axes and the like. The elongated handgrip areas position the user's hands well away from the edge being sharpened. Added efficiency is also gained by the elongated sharpener body providing mountings for both single and double edge sharpener assemblies.

What is claimed is:

1. A blade sharpening device comprising;

an elongated sharpener body, first and second hand-grip areas on the opposite terminal ends of said sharpener body, a central blade sharpener assembly area on said sharpener body, a plurality of blade sharpener assemblies mounted in said central blade sharpener assembly area longitudinally spaced along the longitudinal axis of said sharpener body, said plurality of sharpener assemblies including a first sharpener assembly having a blade sharpener bit and a cooperating dummy bit for sharpening blades having a cutting edge with a single inclined cutting surface and a second assembly with two sharpener bits for sharpening blades having a cutting edge and double inclined cutting surfaces.

2. The sharpening device according to claim 1 wherein said hand-grip areas include hand-grip enhancing means for enhancing manual grip on said sharpener body.

3. The sharpener device according to claim 2 wherein said sharpener body comprises a right circular cylinder, said grip enhancing means comprising a phurality of adjacent depressions in the surface of sharpener body in each said hand-grip areas, said depressions being configured to receive the user's fingers during use of the sharpening device.

4. A hand-held sharpening device for a blade having at least one inclined cutting surface comprising;

an elongated sharpener body formed of two separate elongated matching body segments, said sharpener body including a central blade sharpener assembly mounting area and first and second opposite terminal end hand-grip areas, at least one blade sharpener assembly located within said central area between said hand-grip areas, said blade sharpener assemblies including first and second sharpener bits which are supported in and extend out of said body and which define a V-shaped sharpening notch oriented to contact the inclined surface of a blade to be sharpened and to guide the blade therethrough in a direction transverse to the longitudinal axis of the elongated sharpener body, cavity means in said body for releasably mounting said sharpener bits, said cavity means comprising first and second bit mounting recesses molded into said body segments for mounting said first and second sharpener bits respectively in overlapping relation to form said V-shaped sharpening notch, clamping means for clamping said body segments in assembled position to bold said sharpener bits in overlapping position, said elongated sharpener body being of sufficient length to permit a user's hands to be spaced from opposite sides of an edge to be sharpened while grasping said hand-grip areas and of sufficient circumferential surface extent to provide hand-grip surfaces for the user, whereby the sharpener body may be simultaneously grasped with both hands, said at least one sharpener assembly placed in contact with a blade edge to be sharpened and the sharpener body passed along the inclined cutting surface of the blade.

5. A hand-held sharpening device comprising;

an elongated sharpener body, said sharpener body including a central blade sharpener assembly mounting area and first and second opposite terminal end hand-grip areas, a plurality of blade sharpener assemblies mounted in said central blade sharpener assembly mounting area longitudinally spaced along the longitudinal axis of said sharpener body, said sharpener assemblies including first and second sharpener bits which are supported in and extend out of said body and which define V-shaped sharpening notches for blades to be sharpened, said plurality of blade sharpener assemblies including a first assembly having a blade sharpener bit and a cooperating dummy bit for sharpening blades having a cutting edge with a single inclined cutting surface and a second assembly with two sharpener bits for sharpening blades having a cutting edge with double inclined cutting surfaces, said sharpener body being formed of two separate elongated matching body segments with cavity means for releasably mounting said sharpener bits, said cavity means comprising first and second bit mounting recesses molded into said body segments for mounting said first and second sharpener bits respectively in overlapping relation to form said V-shaped sharpening notch and clamping means for clamping said body segments in assembled position to hold said bits in overlapping position, said elongated sharpener body being of sufficient length to permit a user's hand to be spaced from opposite sides of an edge to be sharpened while grasping said hand-grip areas and of sufficient circumferential extent to provide hand-grip surfaces for the user, whereby the sharpener body may be grasped with both hands, a sharpener assembly placed in contact with a blade edge to be sharpened and the sharpener body passed along the blade edge.

6. The sharpening device according to claim 5 wherein said hand-grip areas include grip enhancing means for enhancing manual grip on said sharpener body.

7. The sharpening device according to claim 6 wherein said hand-grip enhancing means comprises a plurality of adjacent depressions in the surface of said sharpener body in each said hand-grip areas, said depressions being configured to receive the users fingers during use of the sharpening device.

8. A hand-held blade sharpening device comprising;

an elongated sharpener body including a central blade sharpener assembly mounting area and first and second opposite terminal end hand-grip areas on each end thereof, said hand-grip areas including grip enhancing means carried thereby, at least one blade sharpener assembly located within said central area between said hand-grip areas, said at least one sharpener assembly including first and second sharpener bits which are supported in and extend out of said body and which define a V-shaped sharpening notch for blades to be sharpened, cavity means in said body for releasably mounting said sharpener bits, said sharpener body being of sufficient length to permit a user's hands to be spaced from opposite sides of an edge to be sharpened by contact with said at least one blade sharpener assembly while grasping said hand-grip areas and of sufficient surface extent to provide hand-grip surfaces for the user, whereby the sharpener body may be grasped with both hands, said at least one sharpener assembly placed in contact with a blade edge to be sharpened and the sharpener body passed along the blade edge.

9. The sharpening device according to claim 8 wherein said sharpener body is formed of two separate elongated matching body segments, said cavity means comprising;

first and second bit mounting recesses molded into said body segments for mounting said first and second sharpener bits respectively in overlapping relation to form said V-shaped sharpening notch, and clamping means for clamping said body segments in assembled position to hold said sharpener bits in overlapping position.

10. The sharpening device according to claim 9 including;

a plurality of blade sharpener assemblies mounted in said central blade sharpener assembly area longitudinally spaced along the longitudinal axis of said sharpener body, said plurality of blade sharpener assemblies including a first assembly having a blade sharpener bit and a cooperating dummy bit for sharpening implements having a cutting edge with a single surface and a second assembly with two sharpener bits for sharpening implements having a cutting edge with double inclined cutting surfaces.

11. The sharpening device according to claim 10 wherein said hand-grip enhancing means comprises a plurality of adjacent depressions in the surface of said sharpener body in each said hand-grip areas, said depressions being configured to receive the user's fingers during use of the sharpening device.

12. A hand-held sharpening device for a blade having at least one inclined cutting surface, comprising;

an elongated sharpener body, said sharpener body including a central blade sharpener assembly mounting area and first and second opposite terminal end hand-grip areas, and a plurality of blade sharpener assemblies mounted on said central blade sharpener assembly mounting area longitudinally spaced along the longitudinal axis of said sharpener body between said hand-grip areas, said blade sharpener assemblies extending outwardly from said sharpener body and being oriented to contact the inclined cutting surface of a blade to be sharpened and to guide the blade therethrough in a direction transverse to the longitudinal axis of the elongated sharpener body, said plurality of sharpener assemblies including a first sharpener assembly having a blade sharpener bit and a cooperating dummy bit for sharpening implements having a cutting edge with a single cutter blade surface and a second assembly with two sharpener bits for sharpening implements having a cutting edge and double cutter blade surfaces, said elongated sharpener body being of sufficient length to permit a user's hand to be spaced from opposite sides of an edge to be sharpened while grasping said hand-grip areas and of sufficient circumferential surface extent to provide hand-grip surfaces for the user, whereby the sharpener body may be simultaneously grasped with both hands, one of said sharpener assemblies placed in contact with a blade edge to be sharpened and the sharpener body passed along the inclined cutting surface of the blade.

* * * * *

UNITED STATES PATENT AND TRADEMARK OFFICE

CERTIFICATE OF CORRECTION

PATENT NO. : 7,374,475 B2
APPLICATION NO. : 11/054847
DATED : May 20, 2008
INVENTOR(S) : Gary L. Byers It is certified that error appears in the above-identified patent and that said Letters Patent is hereby corrected as shown below:

Col 6, line 56, change “bold” to read --hold--.

Signed and Sealed this

Twelfth Day of August, 2008

JON W. DUDAS
*Director of the United States Patent and Trademark Office*